United States Patent [19]

Haag

[11] 3,945,529

[45] Mar. 23, 1976

[54] SEALING CLOSURE FOR CONTAINERS

[75] Inventor: Walter Haag, Abstadt, Germany

[73] Assignee: Barrel Fresh Service AG., Chur, Switzerland

[22] Filed: Aug. 27, 1974

[21] Appl. No.: 500,889

[30] Foreign Application Priority Data

Aug. 28, 1973 Germany ..... 2343232

[52] U.S. Cl. ..... 220/307; 222/566

[51] Int. Cl.[2] ..... B65D 39/00

[58] Field of Search ..... 220/233, 256, 307, 94 A; 222/566, 569, 570, 541; 285/202, 203, 204

[56] References Cited

UNITED STATES PATENTS

| | | | |
|---|---|---|---|
| 2,889,089 | 6/1959 | Herrick | 222/569 |
| 2,907,489 | 10/1959 | Taylor | 222/569 |
| 3,021,976 | 2/1962 | Tracy | 220/307 |
| 3,113,693 | 12/1963 | Stull | 222/570 |
| 3,135,441 | 6/1964 | Wise | 222/570 |
| 3,269,617 | 8/1966 | Goth | 222/541 |
| 3,282,477 | 11/1966 | Henchert | 222/541 |
| 3,317,070 | 5/1967 | Rausing | 222/541 |
| 3,608,771 | 9/1971 | Monroe | 222/541 |
| 3,776,434 | 12/1973 | Christensen | 220/94 A |
| 3,807,595 | 4/1974 | Zundel | 220/260 |

*Primary Examiner*—William Price
*Assistant Examiner*—Ro E. Hart

[57] ABSTRACT

A sealing closure for containers, more particularly cans and the like, in which a liquid is stored under pressure and is removed therefrom under pressure. The sealing closure of the invention comprises an axially bored plug-like closing body having a conically tapered outer surface, a flange which is adapted to bear against the container top, and an annular peripheral recess disposed between the flange and the said conically tapered outer surface. A sealing formation is arranged in the bore and comprises two spaced-apart annular projections. An ejectable sealing cap is provided which fits into the lower opening of the bore, as well as a removable closure cap for closing the upper opening of the bore.

8 Claims, 6 Drawing Figures

Fig. 4
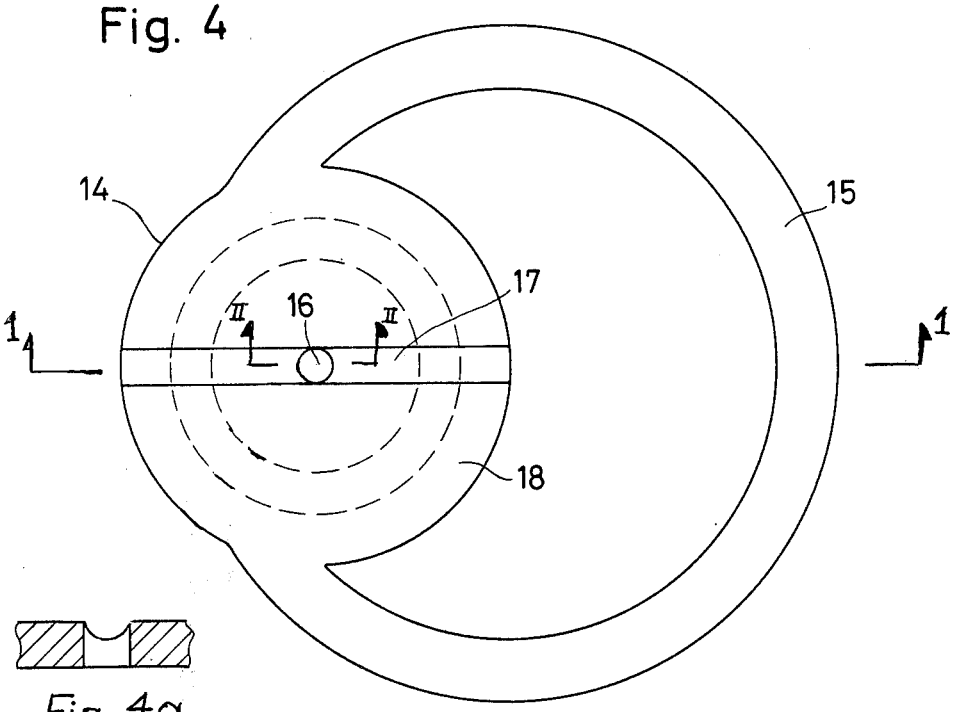
Fig. 4a
Fig. 5
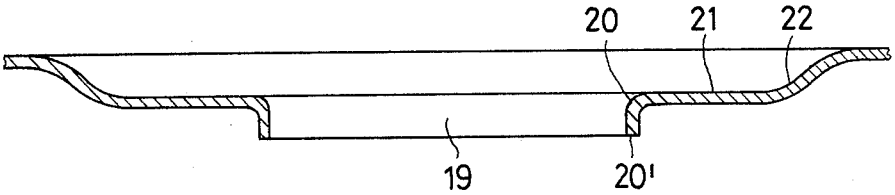

SEALING CLOSURE FOR CONTAINERS

BACKGROUND OF THE INVENTION

The invention relates to sealing closures for containers in which liquid is stored under pressure and is removed under pressure. The sealing closure of the invention comprises an axially bored plug-like closing body having a conically tapered outer surface, a flange which is adapted to bear against the container top, and an annular peripheral recess disposed between the flange and the said conically tapered outer surface. Sealing means are provided in the bore and comprises two annular projections. A removable sealing cap is provided which fits into the lower opening of the bore, as well as a removable closure cap for closing the upper opening of the bore.

In a known sealing closure of the aforedescribed type, the intermediate space between the parallel ring seals (annular projections) is arranged opposite the said peripheral recess, the spacing between these ring seals corresponding essentially to the height of the peripheral recess. The sealing cap which can be fitted into the lower opening of the axial bore is essentially cylindrical, is open at one side and is provided with a radially outwardly projecting flange at the lower outer margin of the open side. This known sealing closure is used for containers, more particularly cans, which are breached with a special miniature tapping arrangement in order to tap the liquid, for example, beer, which is stored under pressure in the container. The sealing closure must on the one hand ensure that the isobarometrically stored liquid remains completely airtightly enclosed in the container, and on the other hand, on breaching, the inserted breaching spike of the tapping arrangement is sealed in such a manner as not to disturb and impair the pressure tightness.

The above-described known sealing closure operates satisfactorily under normal conditions and careful handling when driving it into the bung-hole of a container. It has, however, been observed that, for example, when the insertion of the breaching spike is not carried out absolutely axially, the seal is not always faultlessly provided by the ring seals. Moreover, the danger exists that with forceful insertion of the sealing closure in the bung-hole, the sealing cap is loosened and thereby the seal is no longer completely sound so that under certain conditions pressure gas can escape from the container.

SUMMARY OF THE INVENTION

It is a general object of the invention to provide a sealing closure for containers in which a liquid is stored under pressure and is removed therefrom under pressure. It is another, more specific object of the invention to provide a sealing closure which firmly seals the breaching spike of a tapping arrangement serving for the breaching and tapping, both during and after the insertion, and in which, even with forceful insertion into the bung-hole of the container, the sealing cap at the lower end of the axial bore of the closure body is not loosened, but can nevertheless be pushed out on breaching of the container by means of the breaching spike, without great expenditure of force.

The invention consists therefore essentially of a sealing closure of the kind set forth above which is characterized in that the upper ring seal has a relatively large radius and is arranged at the upper inner margin of the axial bore, and the lower ring seal is arranged at the lower inner margin of the bore.

The lower ring seal preferably has a smaller radius of convex curvature than the upper ring seal. The smallest inner clearance diameters of these ring seals can either be equal to each other or the smallest inner diameter of the upper ring seal may be slightly larger than that of the lower ring seal.

The sealing cap which closes the lower opening of the axial bore, preferably has a flat upper side with a downwardly extending bevel on its marginal edge, a radially outwardly projecting flange arranged at the lower peripheral margin of the sealing cap, and a peripheral circular recess provided between the lower peripheral edge of the bevel and the upper side of the said flange and having a configuration adapted to sealingly contact the lower ring seal of the closure body.

Such a sealing closure ensures a reliable seal during breaching by means of the breaching spike and also when driving the closure into the bung-hole of a container.

The pressing force of the ring seal with the relatively large radius is stronger than that of two relatively closely adjacently running smaller rings seals, which is also the case with the above-mentioned known sealing closure. The larger ring seal is stabler and stronger than two smaller ring seals. Since preferably the highest effective region of the upper ring seal is aligned with a sealing lip provided in the peripheral recess at the outer side of the closure body, the pressing force of this ring seal is still further increased. The lower ring seal surrounds the breaching spike quite firmly after it has ejected the sealing cap, and therefore serves as a supplementary sealing. The sealing cap is preferably provided with a peripheral circular recess in which the lower ring seal on the closure body fits. Thereby, the sealing cap is firmly seated and is neither loosened on driving the sealing closure into the bung-hole of the container, nor prematurely pushed out. By applying pressure on the upper side of the sealing cap, it can be pushed out without difficulty and without too great an expenditure of force.

BRIEF DESCRIPTION OF THE DRAWING

Other characteristics and features will be described in the following detailed description taken in conjunction with the appended drawing, in which:

FIG. 4 is a plan view of the closure cap according to FIG. 3;

FIG. 4*a* is a partial sectional view of a detail of the closure cap along line II—II of FIG. 4; and FIG. 5 is a section through an embodiment of a bung-hole of a container, which can be closed with the sealing closure according to the invention.

DETAILED DESCRIPTION

Figure 1:
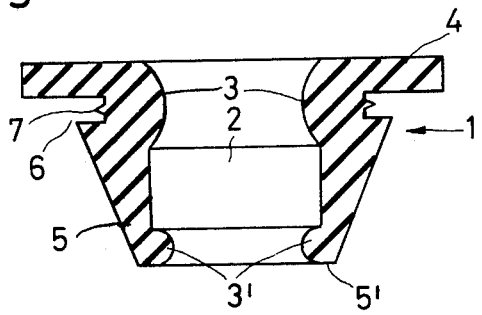
FIG. 1 is a longitudinal section through a closure body of a sealing closure in accordance with the invention.
Figure 2:
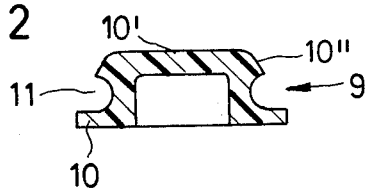
FIG. 2 is a longitudinal section through a sealing cap for the lower opening of the axial bore of the closure body.

Referring now to the drawing, the sealing closure according to the invention consists essentially of three parts, consisting of the closure body 1 preferably of rubber and the two caps 9 and 12 which serve for closing the axial bore 2 of the rubber body 1 which preferably consists of polyethylene or another suitable plastic material.

The plug-like closure body 1 comprises an axial bore 2 which is essentially cylindrical and extends completely therethrough and has two parallel disposed ring seals 3 and 3' which present curved surfaces to the interior of the bore. The arrangement and the configuration of these ring seals is important. The ring seal 3 is arranged at the upper marginal portion of the inner periphery of the axial bore 2 and the other lower ring seal 3' is arranged at the lower marginal portion of the inner periphery of the axial bore. The upper bead ring seal 3 has a relatively large radius, whereas the radius of the lower bead ring seal 3' is smaller. At the upper margin of the closure body 1, a ring-shaped flange 4 extends radially outwardly, its lower side being flat and resting on the peripheral surface of the bung-hole of a container after insertion of the closure of the bung-hole. The outer side 5 of the wall of the closure body 1 extends conically downwards and an annular recess 6 is provided at the junction between the flange and the conically tapered outer side wall. The horizontal radius of the upper ring seal 3 preferably intersects the center line of the ring-shaped recess 6 and thus is arranged precisely opposite this recess at the inner periphery of the axial bore 2. The resilience of the closure body 1 is increased by the conical construction of its wall.

For additional sealing between the sealing closure and the container, the base of the ring-shaped recess 6 is provided with a radially outwardly projecting sealing lip 7 which is pointed in cross-section. Preferably this sealing lip is arranged along the center line of the recess 6 and lies in the plane of the horizontal radius of the ring seal 3. As is visible from the sectional view, in FIG. 1, it follows that the highest effective (radially most inward) point of the ring seal 3 is precisely opposite the tip of the sealing lip 7. After insertion of the sealing closure in the bung-hole 19 (see FIG. 5), this sealing lip lies quite firmly against the inner downwardly bent rim 20 bordering the bung-hole and increases the tightness at this region by the increased force of the ring seal acting on the breaching spike (not illustrated) when it is introduced and also when the closure cap 12 (see FIG. 3) is inserted into the closure body.

The second or lower ring seal 3', the radius of convex curvature of which is smaller than the radius of convex curvature of the upper ring seal 3, is arranged at the lower inner end portion of the axial bore 2 of the closure body 1. Preferably, the curvature of the ring seal merges into the flat under side 5' of the closure body 1.

This flat underside 5' of the closure body 1 serves as a seat for the flange 10 of a sealing cap 9 which closes the lower opening of the axial bore 2. This sealing cap 9 is hat-shaped having a flat upper side 10' the peripheral edge 10'' of which is beveled outwardly and downwardly. The side of the sealing cap 9 opposite the upper side 10' is open and the flange 10 extends radially from the lower marginal section of its outer periphery. The upper side of this flange 10, after insertion of the sealing cap 9 into the lower opening of the axial bore 2 of the closure body 1 rests on the flat lower surface 5' of the closure body 1 and abuts firmly thereon. The sealing cap 9 is pressed with its closed side upwardly into the axial bore 2 of the closure body 1.

The bevel portion 10'' at the upper peripheral margin of the sealing cap 9, the pressing in and also the pushing out of the sealing cap 9 by means of the breaching spike is facilitated, since firstly the bevel portion 10'' slides better over the curved surface of the lower ring seal 3' and secondly the end of the breaching spike obtains a better attack surface for its action.

In a preferred embodiment, the sealing cap 9 is provided with a curved annular groove 11 extending around its exterior, which is disposed between the lower peripheral edge of the bevel portion 10'' and the upper side of the flange 10. The radius of concave curvature of this annular groove 11 corresponds approximately to the radius of convex curvature of the lower bead ring seal 3' in the axial bore 2 of the closure body 1, so that after pressing the sealing cap 9 into the lower opening of the axial bore 2, the ring seal 3' snaps into the annular groove 11. In this manner, the sealing cap 9 is held firmly in the closure body 1 and cannot readily be loosened by a blow and released from its sealing seat. Nevertheless, the sealing cap 9 can be pushed out by a relatively light pressure by means of the breaching spike. For further facilitating the pushing out, the curvature of the annular groove 11 at its upper marginal section bordering on the bevel portion 10'' is preferably somewhat shallower, so that this marginal section slides more easily over the curved portion of the ring seal 3'.

The smallest inner clearance diameter of the lower ring seal 3' is preferably somewhat smaller than the diameter of the circumference formed at the base of the annular groove 11 in the sealing cap 9. In this manner, the sealing force between groove 11 and ring seal 3' in this region is further increased.

The third part of the combination forming the sealing closure is a closure cap 12 by means of which the upper opening of the axial bore 2 of the closure body 1 is closed. This closure cap 12 also acts as a dust cap which prevents the entry of dust into the axial bore of the closure body 1.

Figure 3:
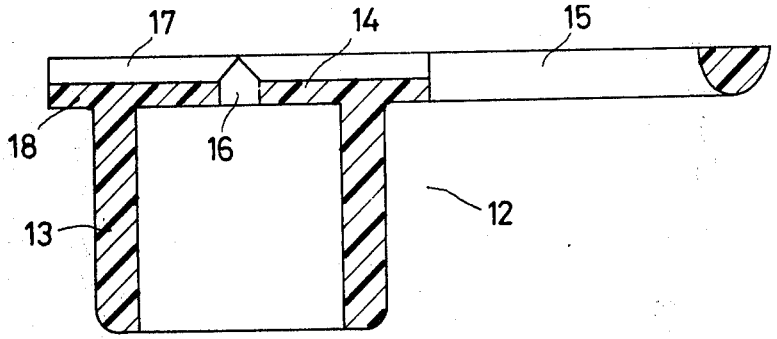
FIG. 3 is a longitudinal section of a closure cap for the upper opening of the inner bore of the closure body, essentially along the line 1—1 of FIG. 4.

An embodiment of the closure cap is illustrated in FIG. 3. This closure cap 12 consists of a cover plate 14 on which a cylindrical extension 13 is formed. The cover plate 14 is preferably round. The outer diameter of the cylindrical extension 13 is smaller than the diameter of the axial bore 2 in the closure body 1, but somewhat larger than the smallest inner clearance diameter of the upper ring seal 3. Thus, on applying the closure cap 12, a light spreading pressure is exerted on the ring seal 3.

The cover plate 14 is provided with a marginally projecting strip 18 extending radially from the top of the cylindrical extension 13, on which a gripping ring 15 is formed which facilitates the lifting of the closure cap 12. Furthermore, a central hole 16 is provided in the cover plate 14, through which the air can escape from the axial bore 2 of the closure body 1, when the closure cap 12 is pressed into the opening of the axial bore 2 of the closure body 1. In this manner, the compression of air in the bore 2 between the upper closure cap 12 and the lower sealing cap 9 is prevented when inserting the upper closure cap 12 into the closure body 1. In order that this hole 16 is not accidentally closed on pushing in the closure cap 12, it terminates in a groove 17 extending transversely over the surface of the cover plate 14, so that blocking of the hole by the thumb or some other article is not readily possible.

A container opening 19 suitable for the sealing closure according to the invention is shown in FIG. 5. The portion 20 of the top wall of the container, surrounding the container opening 19 is bent downwardly. The curve formed thereby merges at 21 into a flat portion which gradually rises at 22 until it reaches the flat cover of the can or container and merges into this flat cover.

Directly after the isobarometric filling of the liquid, for example beer, into the container, the closure body 1, having the lower sealing cap 9 inserted therein, is pressed into the container opening 19. The closure body 1 is introduced so deeply that the upper edge of the conical outer side 5 of the wall of the closure body 1 lies below the lower edge 20' of the bung-hole. Due to the $CO_2$ pressure present in the container, the closure body 1 is pushed outwardly and seals against the lower edge of the bung-hole 19. The pointed sealing lip 7 in the peripheral recess 6 in the closure body 1 lies firmly against the inner margin of the section 20 of the container surrounding the bung-hole. When the bung-hole has been closed in this manner, the upper closure cap 12 having an integral grip ring 15 is introduced.

In order to breach the container and tap the beverage, firstly the upper closure cap 12 is removed and then the breaching spike of the tapping arrangement is pushed into the axial bore of the closure body 1. The inner diameters of the ring seals are somewhat smaller than the outer diameter of the breaching spike (not illustrated) or the outer diameter of the pipe of the breaching spike (not illustrated) is always somewhat larger than the narrowest diameter in the axial bore 2 of the closure body 1, formed by the ring seals 3 and 3' or by the upper ring seal 3. Thus, firstly the upper ring seal 3 embraces the introduced pipe of the breaching spike in a firm sealing manner so that this can be pushed further into the axial bore 2 and the sealing cap 9 which is mounted below can be pushed out without the danger existing that pressure gas escapes from the interior of the container. As soon as the sealing cap 9 slides over the lower ring seal 3', its place is taken by the pipe of the breaching spike, which is also sealingly embraced at this region by the ring seal 3'.

The smallest inner clearance diameters of the ring seals 3, 3' are either of equal size or the smallest inner clearance diameters of the lower ring seal 3' is somewhat smaller than the smallest inner clearance diameter of the upper ring seal 3. This last-mentioned relationship is preferred since the spreading pressure exerted on the lower ring seal 3' by the breaching spike improves the sealing action.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. A sealing closure for containers in which a liquid is stored under pressure and removed therefrom under pressure by means of a tapping arrangement having a breaching spike, comprising in combination, a plug-like closing body having an axial bore and a conically tapered outer side, a flange which is adapted to bear against the container top, said body having an anjular groove disposed between said flange and said conically tapered outer side, a sealing means on said body including at least two ring seals projecting in said bore and axially spaced from each other, an ejectable sealing cap removably mounted in the lower opening of said bore to close said lower opening, as well as a removable closure cap removably mounted in the upper opening of the bore to sealingly close said upper opening, the upper ring seal having a relatively large radius of curvature and being arranged at the upper inner margin of said bore and the lower ring seal being arranged at the lower inner margin of said bore, said removable closure cap being adapted to be penetrated and said sealing cap being adapted to be ejected by said tapping spike when said tapping arrangement is operatively mounted on the sealing closure.

2. The sealing closure as defined in claim 1, wherein the ring seals have curved surfaces convexly projecting into the interior of the bore, the lower ring seal having a smaller radius of convex curvature than the upper ring seal.

3. The sealing closure as defined in claim 2, wherein the smallest inner clearance diameters of said two ring seals are substantially equal.

4. The sealing closure as defined in claim 2, wherein the smallest inner clearance diameter of the upper ring seal is somewhat larger than the smallest inner clearance diameter of the lower ring seal.

5. The sealing closure as defined in claim 1, wherein the upper ring seal is disposed opposite to said annular groove which is disposed at the outer side of the closure body.

6. The sealing closure as defined in claim 5, wherein a sealing lip which is pointed in cross-section extends radially outwardly from the base of said annular groove.

7. The sealing closure as defined in claim 1, wherein said sealing cap has a flat upper side with a beveled marginal edge, a radially outwardly projecting flange arranged at the lower peripheral margin of the sealing cap, and a second annular groove between the lower peripheral edge of the beveled marginal edge and the upper side of the said outwardly projecting flange.

8. The sealing closure as defined in claim 7, wherein the smallest inner clearance diameter of the lower ring seal is somewhat smaller than the smallest diameter clearance of the second annular groove.

* * * * *